United States Patent [19]

Bare et al.

[11] Patent Number: 4,865,261

[45] Date of Patent: Sep. 12, 1989

[54] SPOOLER SYSTEM WITH TEMPORARY, LARGER DIAMETER SPOOLING SURFACE

[75] Inventors: John H. Bare, Kalamazoo; Howard A. Morgan, Otsego; Robert E. Reed, Kalamazoo, all of Mich.

[73] Assignee: United Technologies Automotive, Inc., Dearborn, Mich.

[21] Appl. No.: 116,086

[22] Filed: Oct. 30, 1987

[51] Int. Cl.[4] ..... B65H 54/00

[52] U.S. Cl. ..... 242/47; 242/1; 242/18 R; 242/25 R; 242/67.1 R; 242/68; 242/110

[58] Field of Search ..... 242/47, 53, 18 R, 1, 242/25 R, 54 R, 55, 67.1, 68, 68.1, 68.3, 110, 110.1, 110.2, 110.3, 115, 72

[56] References Cited

U.S. PATENT DOCUMENTS

| | | | |
|---|---|---|---|
| 1,885,192 | 11/1932 | Elssner et al. | 242/110 X |
| 2,789,779 | 4/1957 | Loop | 242/115 |
| 2,971,721 | 2/1961 | Jones | 242/110.2 |
| 3,456,890 | 7/1969 | Lucke | 242/53 |
| 3,825,196 | 7/1974 | Yamazaki | 242/53 |
| 4,674,701 | 6/1987 | Dreher et al. | 242/110.2 |

*Primary Examiner*—Stanley N. Gilreath

[57] ABSTRACT

A spooler system including a special spool having slotted openings in its side flange walls to allow a set of paddles to be inserted through them when the spool is mounted on the spooler, which paddles are located above the spool core and provide a temporary, larger diameter, initial winding surface for the material to be spooled. After the material has been spooled onto the spool directly on the paddles, the paddles, which can be pivoted downwardly, are removed. This leaves the spooled material loosely fitting on the core of the spool, allowing room for the spooled material to shrink along its length without producing profile distortion in the material. A distal end hub element is provided to hold the spool unto the arbor of the spooler, which hub element has a set of radially extending arms which support the undersides of the paddles during the spooling operation. Roller wheels on the terminal ends of the arms allow the arms to be easily rolled in under the paddles. A pair of lever arms are provided on the hub element for clamping it to the arbor.

18 Claims, 2 Drawing Sheets

SPOOLER SYSTEM WITH TEMPORARY, LARGER DIAMETER SPOOLING SURFACE

TECHNICAL FIELD

The present invention relates to a spooling device, especially one for tubular material or other extended, linear material which shrinks after spooling, and more particularly to one which eliminates profile distortion in the material from occurring after the spooling process. Even more particularly, the present invention relates to a spooler system in which a radially spaced, winding surface is temporarily presented above the core of the spool upon which the material is ultimately to be carried and thereafter removed to produce a loosely fitting, wound material on the spool, which allows room for the material to shrink along its length without profile distortion.

BACKGROUND ART

It is common in the art to wind long pieces of tubular or other extended, linear material onto a spool for storage, transportation and ultimate use.

However, any material that has post-winding shrinkage is subject to profile distortion, if wound directly on a rigid surface, such as a standard spool which has a rigid core.

Thus, for example, in the case of hollow core, polyvinylchloride (PVC) tubular material used, for example, for car seat welting, the material has an inherent tendency to shrink after it has been manufactured. When the material has been wound onto a spool, the shrinkage of the material working against the unyielding, rigid core of the spool, causes the material to become distorted in its profile or cross-sectional shape.

This causes the material to be less desirable or even unusable for its intended use, namely, for example, as car seat welting.

SUMMARY OF THE INVENTION

The present invention is designed to minimize, if not eliminate, disfiguring or profile distortion of the wound material after the material is packaged on a spool. To achieve this, the present invention utilizes a powered spooler providing a "false" or temporary, removable spooling surface made up of, for example, a plurality of circumferentially spaced, curved paddles that hold the material being wound up away from and above the core of the spool during the spooling or winding process.

In the preferred embodiment the multiple (e.g. three) paddles are attached to a mounting base by a pivoting connection. An outer, distal end plate element or hub with preferably roller bearings or wheels is positioned at the free, distal ends of the multiple paddles to provide radial support for them during the winding process and is detachably located on the distal end of a centrally located, driven arbor or shaft.

Special spools having spool flanges with openings or slots in their end flanges in like positions to accommodate the multiple paddles are used to allow the paddles to enter the side, flange ends of the spool over and spaced above the core and protrude through the distal spool end to reach the supporting, distal end plate element.

After the material is wound, the end plate element is removed to allow the paddles to be free to collapse or pivot inward, providing for easy removal of the spool and its spooled material from the "collapsed" spooler of the present invention.

The spooled material, having been wound on the exterior surfaces of the spooler paddles, which had a greater, effective diameter than that of the spool core, then has room or space to contract about the spool core without undergoing profile distortion. The spooled material thereby retains its original cross-sectional or profile shape for its ultimate intended use.

The foregoing and other features and advantages of the present invention will become more apparent from the following description, drawings and claims.

BEST MODE FOR CARRYING OUT THE INVENTION

Figure 1:
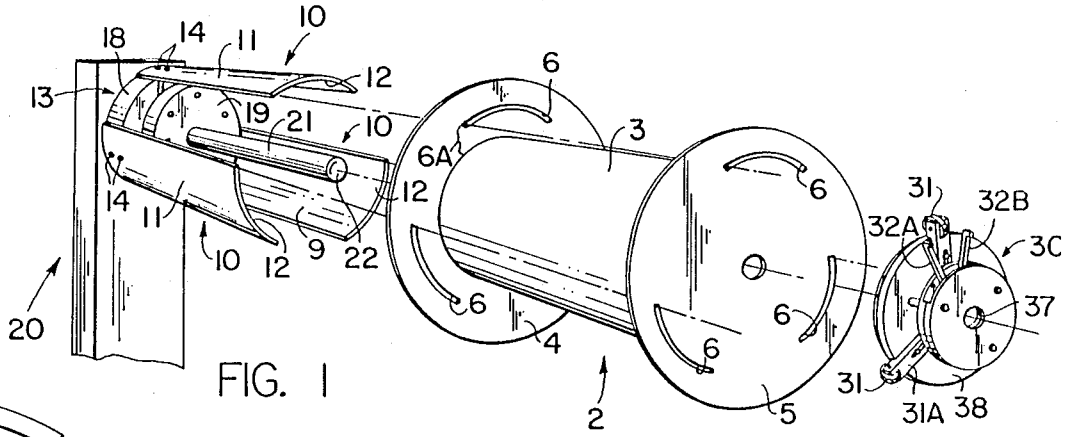
FIG. 1 is a perspective, exploded view of the preferred embodiment of the spooler of the present invention, with the customized, special slotted spool being mountable on the spooler, along with the terminal hub end piece or plate element.

As can be seen in FIG. 1, the spool 2 upon which the material 1 is to be wound includes a rigid, cylindrical core 3 having opposed, radially extended, end flanges or walls 4 & 5. In the spools of the prior art, the elongated, linear or tubular material 1 was merely wound directly on and around the core of the spool, usually with some degree of tension or tightness. If the material 1 was of such a nature that it required or involved post-spooling shrinkage, the material was subject to being distorted and strained in profile due to the presence of the rigid, underlying, unyielding surface presented by the exterior of the cylindrical, spool core.

However, in contrast to the direct winding of the material 1 onto the rigid, exterior, cylindrical surface of the core 3, in the present invention a set of, for example three, paddle members 10 are inserted over and preferably spaced above the exterior surface of the core 3. The material 1 is thus wound around and on the curved, circumferentially spaced, exterior sides 11 of the paddle members 10, rather than directly on the exterior surface of the spool core 3, the latter having a lesser diameter than the former (note FIGS. 1 & 4).

Figure 4:
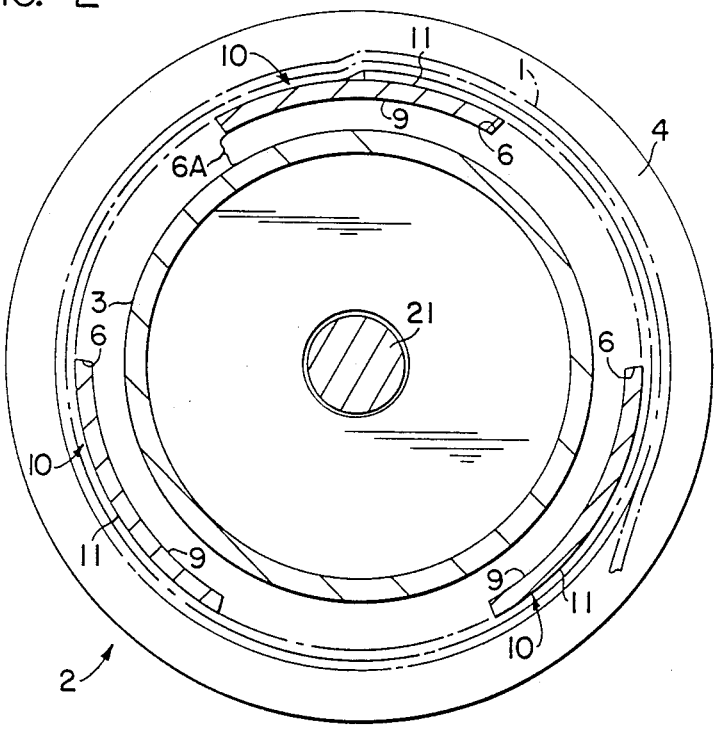
FIG. 4 is a cross-sectional view at the mid-point of the spooler of FIG. 1, with the spool upon which the material is to be wound in position on the spooler and with the spooled material being shown in phantom line wrapped around the exterior surfaces of the paddles of the spooler.

As can be visualized from FIG. 1, the paddle members 10 are inserted through slots 6 located in the spool end flanges 4, 5 and are spaced above the exterior surface of the core 3 a distance 6A (also note FIG. 4). The paddles 10 extend across the complete, longitudinal length of the spool 2 and its core 3 and through both end flanges 4, 5 extending through and past the like-positioned openings or curved slots 6. As can be seen best in FIG. 4, the outer surfaces 11 of the paddles 10 define a curved winding surface upon which the material 1 is initially wound having a greater outer diameter than that of the core 3.

After the spool 2 with its slots 6 have been inserted with the paddles 10 extending through them onto the powered winder 20, which serves as a platform from which the paddles 10 at least generally axially extend, the end plate element 30 is mounted onto the distal end 22 of the powered shaft or arbor 21 to hold the spool 2 unto the arbor 21.

Figure 3:
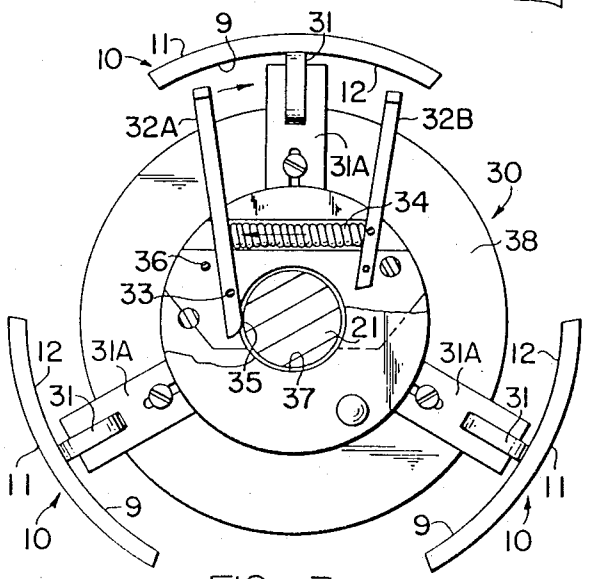
FIG. 3 is a distal end view, partially cut away, of the end plate element of the spooler assembly of FIG. 1, showing in close-up detail part of the internal structure of the end plate element when mounted on the arbor of the spooler.
Figure 2:
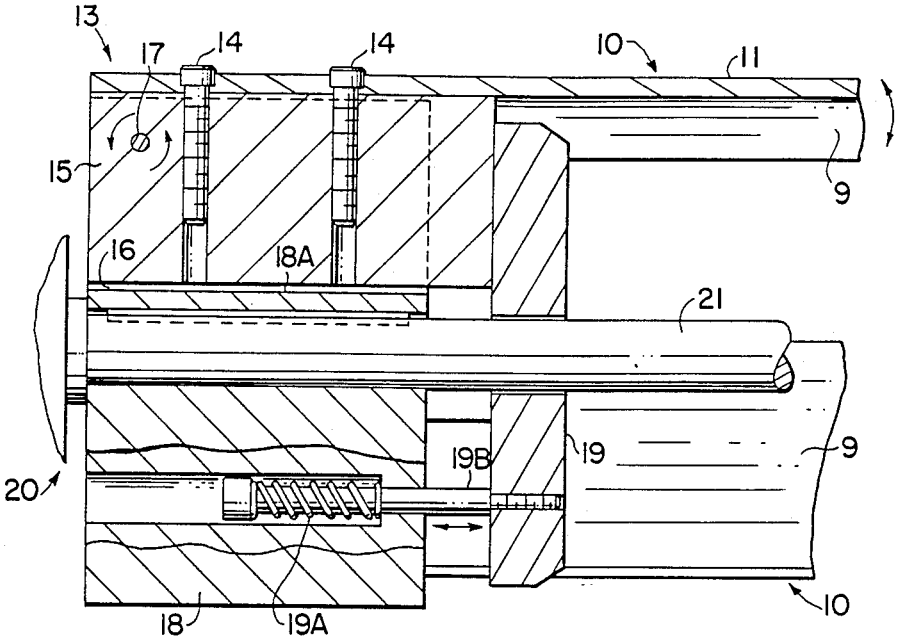
FIG. 2 is a partial, side, cross-sectional view of the proximal end of the spooler of FIG. 1, showing the inner, pivoting, connecting structure of one of the paddles to the main part of the spooler.

The end plate element 30 includes radial extensions or arms 31A having roller bearings or wheels 31 at their terminal ends, upon which wheels the distal ends of the paddles 10 rest for support (note FIG. 3). A centrally located opening 37 is included, through which the distal end 22 of the arbor shaft 21 can extend.

After the empty spool 2 and the end plate 30 have been completely mounted onto the arbor 21 of the powered winder platform 20, the terminus or spool end of the material 1 is attached to or initially wrapped around the spool 2. The paddle members 10 along with the spool 2 and the end plate element 30 and shaft 21 are all rotated together by the powered spooler 20, until the desired amount of material 1 is wound up around the paddle members 10 up over the core 3 of the spool 2.

At this point, the end plate hub element 30 is removed, allowing the paddles 10 to be able to collapse or pivot inwardly about their pivot connections 13, described more fully below. The spool 2 can then be easily pulled off and removed from the arbor 21 of the spooler mechanism 20.

Due to the gap 6A between the under sides 12 of the paddles 10 and the exterior surface of the core 3 and the thickness of the paddles, the two of them producing an off-set, there is a loose fit of the layers of material 1 with respect to the exterior surface of the core 3. This loose fit prevents or at least minimizes any profile distortion that would otherwise have occurred, if the material 1 had instead been wound directly onto the rigid, exterior surface of the core, when the material 1 undergoes any post-spooling or post-winding shrinkage along its length.

As can best be seen in FIG. 3, each paddle member 10 is attached by two bolts 14 to its respective pivot block 15, which in turn is pivotally supported in its respective slot by pivot pin 17. A bottom gap 16 is included between the pivot block 15 and the rear block 18. Due to the presence of the bottom gap 16, the paddle block can pivot about the pin 17 (note curved directional arrows), until its rear or forward, bottom edge comes into contact with the bottom slot surface 18A, blocking any further up or down pivoting movement of the paddles 10 with respect to its rear, proximal mounting to the basic spooler body 20.

A spring-biased, "floating" front block 19 holds the paddle pivot blocks 15 back in compression, under the power of the spring 19A working in conjunction with bolt pins 19B, holding the paddles 10 usually in a normal, ninety degree or horizontal disposition. However, the spring 19A merely provides a biasing force, and the paddles 10 are relatively free without great force to be moved upward or downward about the pivot pin 17 against the force of the spring 19A.

With reference to FIGS. 1 & 3, the end plate hub element 30 is frictionally engaged with and clamped onto the arbor or shaft 21 by means of the lever arms 32A & 32B, the former being pivotally mounted on pin 33, while the latter is fixed. A spring 34 under compression pushes out (note straight directional arrow) against the moveable lever arm 32A, causing the distal tip 35 to compressively bear against the outer surface of the shaft 21, holding the end plate hub element 30 to the shaft 21. Additionally, the presence of the roller wheels 32 within the curvatures of the curved undersides 14 of the paddles 10 further helps to stabilize and fix the end plate element 30 to the spooler 20 for common rotation together.

When it is desired to remove the end plate element 30 from the shaft 21 to, for example, remove the filled spool 2 from the spooler 20, the lever arm 32A is pushed inward (note curved directional arrow) against the force of the spring 34, pulling the distal end 35 up away from and out of contact with the shaft 21. This allows the end plate element 30 to then be pulled axially off of the distal end 22 of the shaft 21. A stop pin 36 is included within the end plate element 30 to limit the outward movement of the lever arm 32A under the action of the spring 34, when the distal tip 35 is not in engagement with the shaft 21.

To remount the end plate element 30 unto the shaft 21, the steps are merely reversed. Namely, an empty spool 2 is first mounted on the shaft 21 with the paddles 10 extending through the slots 6, and the end plate element 30 is axially slid unto the shaft 21 with the lever arm 32A pushed inward against the force of the spring 34. Once the inner side of the back plate 38 is flush against the outer side flange wall 5 of the spool 2, the lever arm 32A is released, allowing the distal lever tip 35 to again compressively and frictionally engage the exterior surface of the shaft 21.

It is noted that the presence of the roller wheels 31, whose axes are cordially positioned, allows the radially extended arms 31A to be easily rolled in against the undersides 12 of the paddles 10, as the end plate element 30 is mounted and axially moved onto the shaft 21.

Exemplary details for the exemplary, preferred embodiment are outlined below:

| | |
|---|---|
| tubular material 1 | hollow core polyvinylchloride (PVC) used for car seat welting |
| spacing gap 6A | 3/8" |
| diameter of spool core 3 | 6" |
| outer diameter of side flanges 4, 5 | 12" |
| winding speed | 210'/minute |

The desired gap 6A of course depends upon the amount of slack needed to compensate for post-spooling shrinkage of the material 1, and, with a sufficiently thick paddle 10, the underside 12 could be made flush with the exterior surface of the core 3, leaving a gap 6A of zero. In such a case, the needed off-set for the initial winding or spooling surface from the spool core 3 is provided by the thickness of the paddles 10 themselves. The widths of the paddles 10 are subject to great variation, from merely each being a rod to more preferably being arcuately extended, having a significant, curved width with respect to its thickness, as shown.

Although the embodiment described is preferred, it is noted that it is possible to have the paddles extend through only the closer or proximal spool flange 4 and across the core 3, rather than extend through both flanges 4, 5. Also, not all of the paddles need to be pivotally mounted, but it is preferably that at least one of them is, and, even when the paddles 10 do extend through the outer or distal flange wall 5, not all must extend through it, but at least one and preferably at least two. The flange openings or slots 6 can likewise be adjusted.

Lead-in guides (not illustrated) for the material 1 can be provided adjacent to the spool 2 for holding and guiding the material to the spool during the spooling process. Additionally, more than one spooling station, for example two, each with an arbor with paddles, can be provided on the spooler platform 20, for example one above the other, to allow one of them to be unloaded and reloaded, while the other is being spooled and vice-versa, increasing productivity.

Although this invention has been shown and described with resect to a detailed embodiment thereof, it will be understood by those skilled in the art that various changes in form, detail and application thereof may be made without departing from the spirit and scope of the claimed invention.

Having thus described a typical embodiment of the invention, that which is claimed as new and desired to be secured by Letters Patent is:

I claim:

1. A spooler system for Winding elongated, linear material onto a spool, comprising:

a spool having a core and spaced, side end flanges extending radially out from the ends of the core, the material ultimately to be wound on the spool being carried by the core between said end flanges, at least one of said end flanges having a plurality of circumferentially spaced openings through it;

a powered platform having a rotatable arbor extending out therefrom, onto which said spool can be mounted; and a plurality of axially extending, circumferentially spaced paddles carried by said powered platform and having outer exterior surfaces defining a curved winding surface greater than the diameter of said core of said spool, each of said paddles also having an inner interior side surface, a free, distal end and a mounted end, said paddles extending out a distance at least as great as the axial length of the spool core and being positioned in like position to said flange openings and being of a size to be placed through said flange openings extending from end to end of said core; the material to be wound on said spool being initially wound on said outer surfaces of said paddles while said spool is mounted on said powered platform with said paddles extending through said flange openings, with said paddles thereafter being removed, allowing the wound material to be carried by said core in loose fit about said core, allowing for the elongated material to thereafter shrink along its length without profile distortion.

2. The spooler system of claim 1, wherein at least one of said paddles is pivotally mounted on said platform, allowing it to be pivoted downwardly when the spool is removed from the arbor.

3. The spooler system of claim 2, wherein all of said paddles are pivotally mounted.

4. The spooler system of claim 1, wherein said paddles have a curved, arcuate shape on their outer surfaces.

5. The spooler system of claim 1, wherein said openings in said end flange are located above the exterior surface of said core.

6. The spooler system of claim 1, wherein there is further included:

a distal end hub element locatable on the distal end of said arbor to hold said spool unto said arbor

7. The spooler system of claim 6, wherein said end hub element has a plurality of radially extending arms which contact and radially support the inner surfaces of the distal ends of said paddles during the spooling operation.

8. The spooler system of claim 7, wherein said arms include at their terminal ends roller bearings allowing said arms to be rolled in under said paddles when said end hub element is placed on the distal end of said arbor.

9. The spooler system of claim 8, wherein said roller bearings are roller wheels who axes are cordially positioned.

10. The spooler system of claim 1, wherein both of said end flanges have said openings in like positions, and wherein at least two of said paddles extend completely through said openings past the distal end of said spool when it is mounted on said arbor.

11. The spooler system of claim 10, wherein there is further included:

a distal end hub element locatable on the distal end of said arbor to hold said spool unto said arbor, said end hub element having a plurality of radially extending arms which contact and radially support the inner surfaces of the distal ends of said paddles extending completely through said openings during the spooling operation.

12. The spooler system of claim 11, wherein said end hub element has an arbor hole centrally located in it allowing it to be slid onto the distal end of said arbor.

13. The spooler system of claim 12, wherein there is further included:

clamping means for clamping said end hub element to said arbor along the axis of the arbor obtaining proper positioning of said radially extending arms with respect to said free ends of said paddles to allow the paddles to be positioned relative to the arbor; whereby after winding the material about the paddles, the end hub element is removed from the arbor permitting the paddles to collapse inwardly towards the arbor to assist in the removal of the now-wound material from the spooler.

14. The spooler system of claim 13, wherein said clamping means comprises:

a locking plate;

a fixed lever attached to the locking plate and extending radially therefrom;

a moveable lever pivotally attached to said locking plate and extending radially therefrom, said moveable lever being located in proximity to said fixed lever, the moveable lever having an arbor engaging end and a grasping end; and urging means for urging the grasping end of the moveable lever away from said fixed lever and subsequently urging said arbor engaging end towards the axis of the arbor, squeezing the levers together allowing the end hub and the locking plate to be installed on the arbor and, upon releasing said levers, said urging means causing the engaging end of the moveable lever to abut against the arbor, holding the end hub in position, and squeezing the levers together allowing the end hub to be removed from the arbor.

15. A method of spooling elongated, linear material unto a spool, comprising the following steps:

(a) providing a spooler system including - a spool having a core and spaced, side end flanges extending radially out from the ends of the core, the material ultimately to be wound on the spool being carried by the core between said end flanges, at least one of said end flanges having a plurality of circumferentially spaced openings through it;

a powered platform having a rotatable arbor extending out therefrom, onto which said spool can be mounted;

a plurality of axially extending, circumferentially spaced paddles carried by said powered platform and having outer exterior surfaces defining a curved winding surface greater than the diameter of said core of said spool, each of said paddles also having an inner interior side surface, a free, distal end and a mounted end, said paddles extending out a distance at least as great as the axial length of the spool core and being positioned in like position to said flange openings and being of a size to be placed through said flange openings extending from end to end of said core;

(b) mounting the spool onto said arbor with said paddles extending through said flange openings and extending from end to end over said spool core;

(c) winding the material to be wound on said spool initially on said outer surfaces of said paddles, while said spool is mounted on said powered platform with said paddles extending through said flange openings; and (d) thereafter removing said paddles from said spool, allowing the wound material to be carried by said core in loose fit about said core, allowing for the elongated material to thereafter shrink along its length without profile distortion.

16. The method of claim 15, wherein at least one of said paddles are pivotally mounted, and wherein there is included in step "d" the further step of:

pivoting the pivoting paddle(s) down as the spool is removed from the arbor.

17. The method of claim 15, wherein said spooler includes a distal end hub element for holding the spool unto said arbor; and wherein in step "b" there is further included the step of:

clamping said end hub element to said arbor on the distal side of the spool after the spool has been mount on the arbor.

18. The method of claim 16, wherein said end hub element includes a set of radially extending arms; and wherein there is further included the step of:

supporting the distal ends of at least two of said paddles with said radially extending arms as the material is wound onto said paddles.

* * * * *

UNITED STATES PATENT AND TRADEMARK OFFICE

CERTIFICATE OF CORRECTION

PATENT NO. : 4,865,261

DATED : September 12, 1989

INVENTOR(S) : JOHN H. BARE ET AL

It is certified that error appears in the above-identified patent and that said Letters Patent is hereby corrected as shown below:

ON THE TITLE PAGE

[22] "October 30, 1987" should be --November 3, 1987--

Signed and Sealed this

Thirteenth Day of October, 1992

*Attest:*

DOUGLAS B. COMER

*Attesting Officer*

*Acting Commissioner of Patents and Trademarks*